US005924485A

United States Patent [19]

Kobayashi et al.

[11] Patent Number: 5,924,485

[45] Date of Patent: Jul. 20, 1999

[54] HEAT EXCHANGER CONSTRUCTED BY A PLURALITY OF TUBES

[75] Inventors: Osamu Kobayashi, Kariya; Ken Yamamoto, Obu, both of Japan

[73] Assignee: Denso Corporation, Kariya, Japan

[21] Appl. No.: 09/074,529

[22] Filed: May 7, 1998

[30] Foreign Application Priority Data

May 9, 1997 [JP] Japan ..... 9-119654

[51] Int. Cl.[6] ..... F28F 9/02

[52] U.S. Cl. ..... 165/173; 165/DIG. 488; 29/890.052

[58] Field of Search ..... 165/173, 174, 165/176, 110; 29/890.052

[56] References Cited

U.S. PATENT DOCUMENTS

| | | | |
|---|---|---|---|
| 4,308,652 | 1/1982 | Woodhull, Jr. | 29/890.052 |
| 5,245,836 | 9/1993 | Lorentzen et al. | 62/174 |
| 5,320,165 | 6/1994 | Hughes | 165/153 |
| 5,481,800 | 1/1996 | Hutto et al. | 29/890.043 |
| 5,607,012 | 3/1997 | Buchanan et al. | 165/173 |

FOREIGN PATENT DOCUMENTS

| | | |
|---|---|---|
| 63-5479 U | 4/1988 | Japan . |
| 63-54979 U | 4/1988 | Japan . |

*Primary Examiner*—Allen Flanigan
*Attorney, Agent, or Firm*—Harness, Dickey & Pierce, PLC

[57] ABSTRACT

An inside wall surface of a cap covering the end portion of a header tank is formed into a spherical shape, and a connecting portion between the inside wall surface of the cap and a inside wall surface of a tank portion is separated away from a connecting portion between the inside wall surface of the tank portion and an outside wall surface of a tube. Thus, the brazing material is suctioned into both connecting portions (both gaps) sufficiently, and both connecting portions are brazed firmly.

8 Claims, 3 Drawing Sheets

HEAT EXCHANGER CONSTRUCTED BY A PLURALITY OF TUBES

CROSS REFERENCE TO RELATED APPLICATION

This application is based on and incorporates herein by reference Japanese Patent Application No. Hei 9-119654 filed on May 9, 1997.

BACKGROUND OF THE INVENTION

1. Field of the Invention

The present invention relates to a heat exchanger for a refrigerating system where carbon dioxide ($CO_2$), as a refrigerant, is used in a super-critical region of a refrigerating cycle.

2. Description of Related Art

Recently, it has been required to avoid the use of freon as a refrigerant in refrigerating systems. For example, JP-B-7-18602 discloses a vapor compression type refrigerating cycle ($CO_2$-refrigeranting cycle) where carbon dioxide ($CO_2$) is used as a refrigerant in place of freon.

The $CO_2$-refrigeranting cycle operates in the same manner as the conventional vapor compression type refrigerating cycle does where the freon is used as a refrigerant. That is, as denoted by A-B-C-D-A in FIG. 7 (Mollier chart of the $CO_2$-refrigerating cycle), gas-phase $CO_2$ is compressed (A-B) by a compressor to high-temperature and high-pressure super-critical phase $CO_2$, and the super-critical phase $CO_2$ is cooled (B-C) by a heat emitter (gas cooler). The super-critical phase $CO_2$ is pressure-reduced (C-D) by a pressure reducer to a gas-liquid phase $CO_2$, and the gas-liquid phase $CO_2$ is evaporated (D-A) by an evaporator while cooling an outside fluid by absorbing heat from the outside fluid.

The $CO_2$ changes from super-critical phase to gas-liquid phase when the pressure thereof becomes lover than a saturated liquid pressure (pressure at a cross point between a segment CD and a saturated liquid line in FIG. 7). When the $CO_2$ changes from a condition (C) to a condition (D) slowly, the $CO_2$ changes from the super-critical phase to the gas-liquid phase via liquid phase.

In the super-critical region, the molecule of $CO_2$ moves as in the gas phase while the density of $CO_2$ is substantially the same as the liquid-density thereof.

The critical temperature of $CO_2$ is about 31° C., which is lower than that of freon (for example, the critical temperature of R12 is 112° C.). Thus, when the outside air temperature is high, the temperature of $CO_2$ in the heat emitter is higher than the critical temperature. As a result, $CO_2$ is not condensed at the outlet side of the heat emitter (segment BC does not cross the saturated liquid line).

The condition (C) of $CO_2$ at the outlet side of the heat emitter depends on the pressure of $CO_2$ discharged by the compressor and the temperature of $CO_2$ at the outlet side of the heat emitter. As the outside air temperature cannot be controlled, the $CO_2$ temperature at the outlet side of the heat emitter cannot be controlled.

Accordingly, the condition (C) can be controlled by only controlling a discharge pressure in the compressor ($CO_2$ pressure at the outlet side of the heat emitter). That is, when the outside air temperature is high in summer or the like, the $CO_2$ pressure at the outlet side of the heat emitter needs to be raised as denoted by E-F-G-H-E in FIG. 7, for attaining a sufficient cooling performance (enthalpy difference).

For example, the maximum $CO_2$ pressure in the $CO_2$-refrigerating cycle is about ten times as high as that in the conventional refrigerating cycle where the freon is used as refrigerant.

As described above, in the $CO_2$-refrigerating cycle, because the maximum refrigerant pressure is much higher than that in the conventional refrigerating cycle, a heat exchanger used in the conventional refrigerating cycle cannot be applied to the $CO_2$-refrigerating cycle.

JP-U-63-54979 discloses a heat exchanger in which the end portion of a header tank is formed into a semi-sphere shape. The strength of the end portion of this header tank is high. However, this heat exchanger is formed by stacking plural thin plates of a predetermined shape, and by brazing them together. Thus, as this heat exchanger has many connecting portions, the pressure strength thereof is not sufficient in view of the entire heat exchanger.

SUMMARY OF THE INVENTION

An object of the present invention is to provide a heating heat exchanger, in which each connecting portion is brazed firmly for attaining a high pressure-strength.

According to a first aspect of the present invention, a first connecting portion (cap-gap) between a cap and a tank portion is separated from a second connecting portion (tube-gap) between the tank portion and a tube by a predetermined distance. Thus, the brazing material is suctioned into both connecting portions (both gaps), and both connecting portions are brazed firmly. As a result, the high pressure-strength is attained in the entire heat exchanger.

According to a second aspect of the present invention, a columnar like-inside space is formed in a tank portion, and an inside wall surface of the cap includes a spherical surface. That is, the inside wall surface of the cap is connected tangentially and smoothly (without a sharp corner) to the inside wall surface of the tank portion. Thus, a stress concentration is reduced at the connecting portion, thereby increasing the pressure-strength of a header tank formed by the cap and the tank portion.

According to a third aspect of the present invention, an outer shape of the header tank is formed into a columnar shape both ends of which are flat. Therefore, the thickness of the end corner portion of the header tank is large, thereby increasing the strength of the header tank to an outer force acting on the cap from the outside.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PREFERRED EMBODIMENTS

Figure 1:
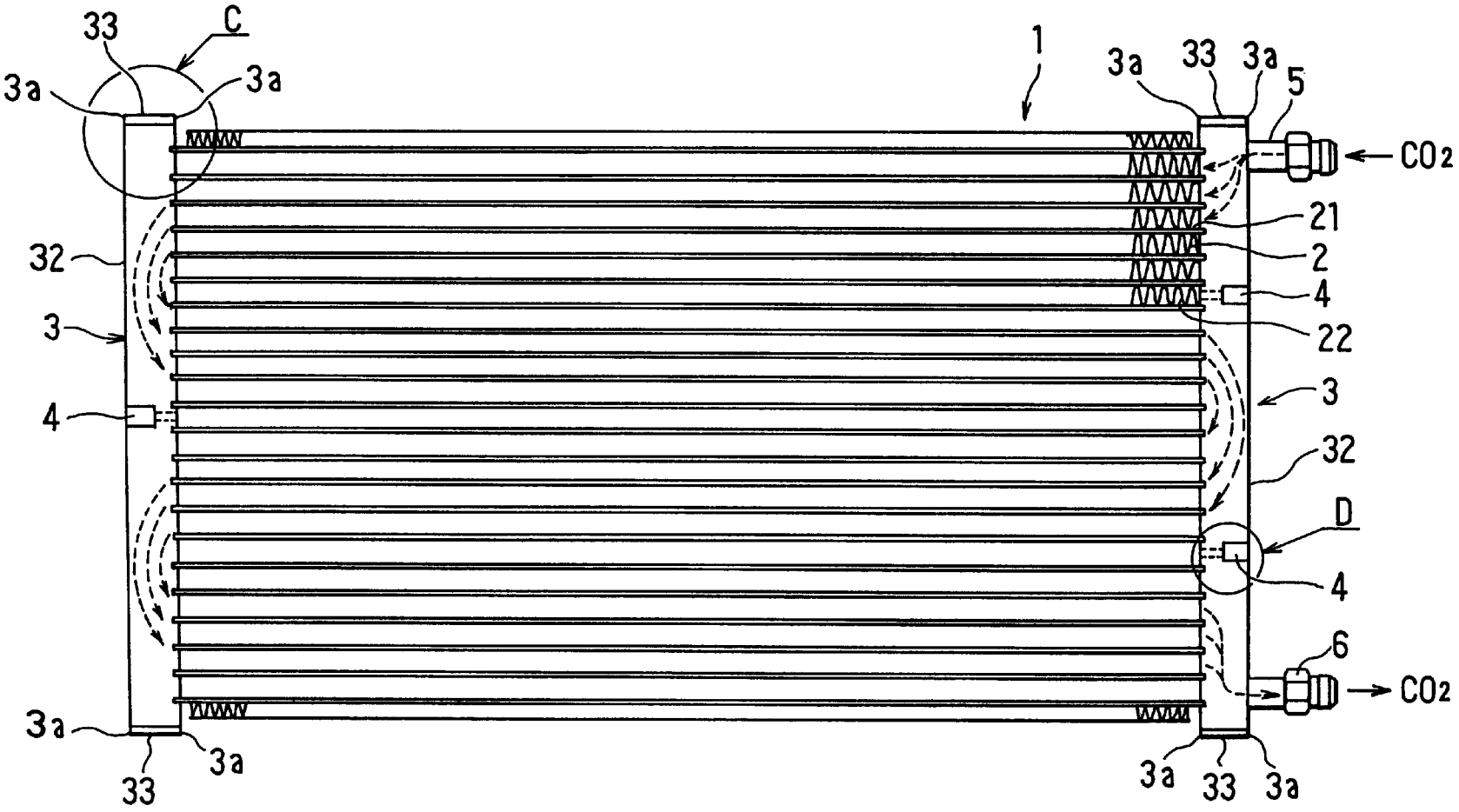
FIG. 1 is a front view showing a heat emitter according to a present embodiment.

Referring to the drawings, preferred embodiments of the present invention will be described.

First Embodiment

In a present embodiment, a heat exchanger according to the present invention is applied to a heat emitter 1 in a refrigerating cycle where carbon dioxide ($CO_2$) is used as a refrigerant to provide a $CO_2$-refrigerating cycle.

The heat emitter 1 includes a core portion 2 carrying out heat exchange between the refrigerant ($CO_2$) and air. The core portion 2 includes a plurality of tubes 21 made of aluminum (A1100) through which the refrigerant flows, and a plurality of cooling fins 22 disposed between the adjacent tubes 21. The cooling fin 22 is made of aluminum (A3003) and formed into a corrugate shape.

The tubes 21 and the cooling fins 22 are brazed integrally by Al—Si brazing material clad on both surfaces of the cooling fins 22.

Figure 2:
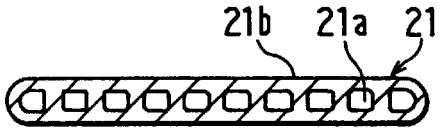
FIG. 2 is a cross sectional view of a tube.

In each tube 21, as shown in FIG. 2, a plurality of refrigerant passages 21*a* penetrating in the longitudinal direction of the tube 21 are formed by an extruding process. The refrigerant passage 21*a* is formed into a rectangular shape in cross section the corner of which is rounded for enlarging a cross sectional-area, and relieving a stress concentration.

Figure 3:
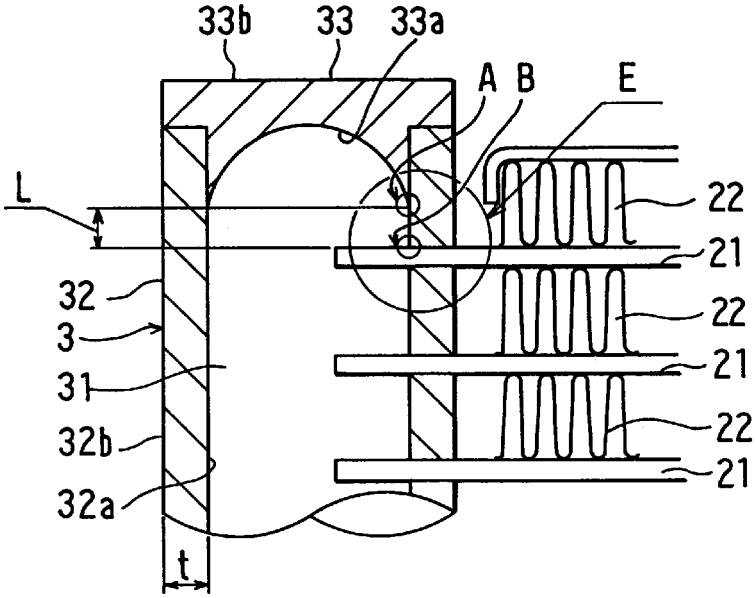
FIG. 3 is an enlarged cross sectional view of circle C in FIG. 1.

Header tanks 3 are provided at both side ends of the plural tubes 21 in the longitudinal direction thereof. The header tank 3 has an inside space 31 with which the tubes 21 (refrigerant passages 21*a*) communicate as shown in FIG. 3, and extends in a direction perpendicular to the longitudinal direction of the tube 21.

Figure 5:
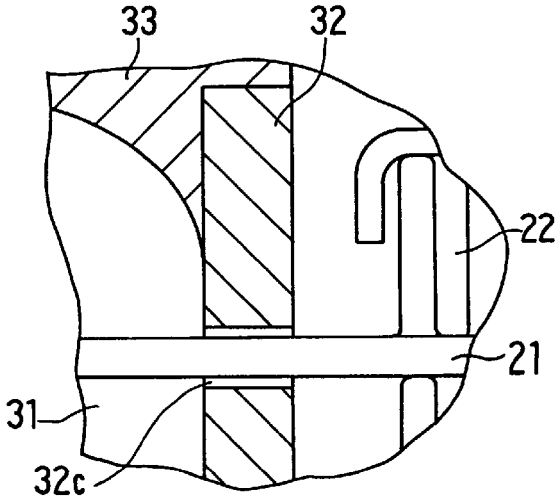
FIG. 5 is an enlarged view of circle E in FIG. 3.
Figure 6:
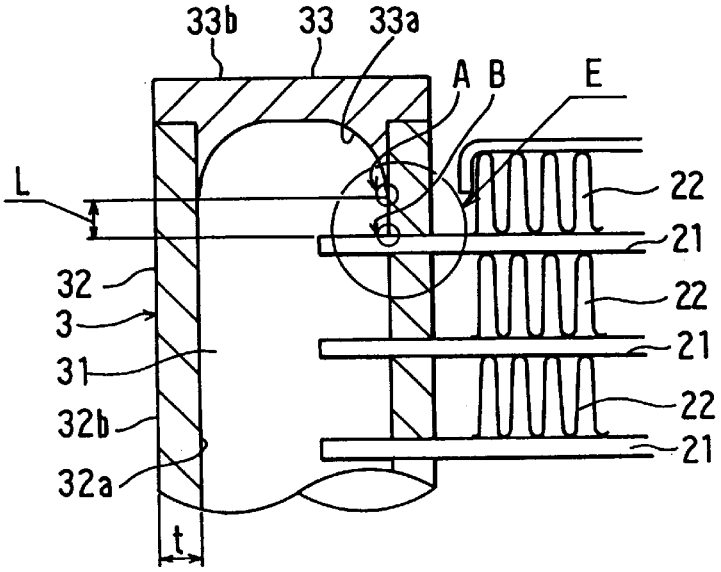
FIG. 6 is an enlarged view of a modification showing a part corresponding to circle C in FIG. 1.
Figure 7:
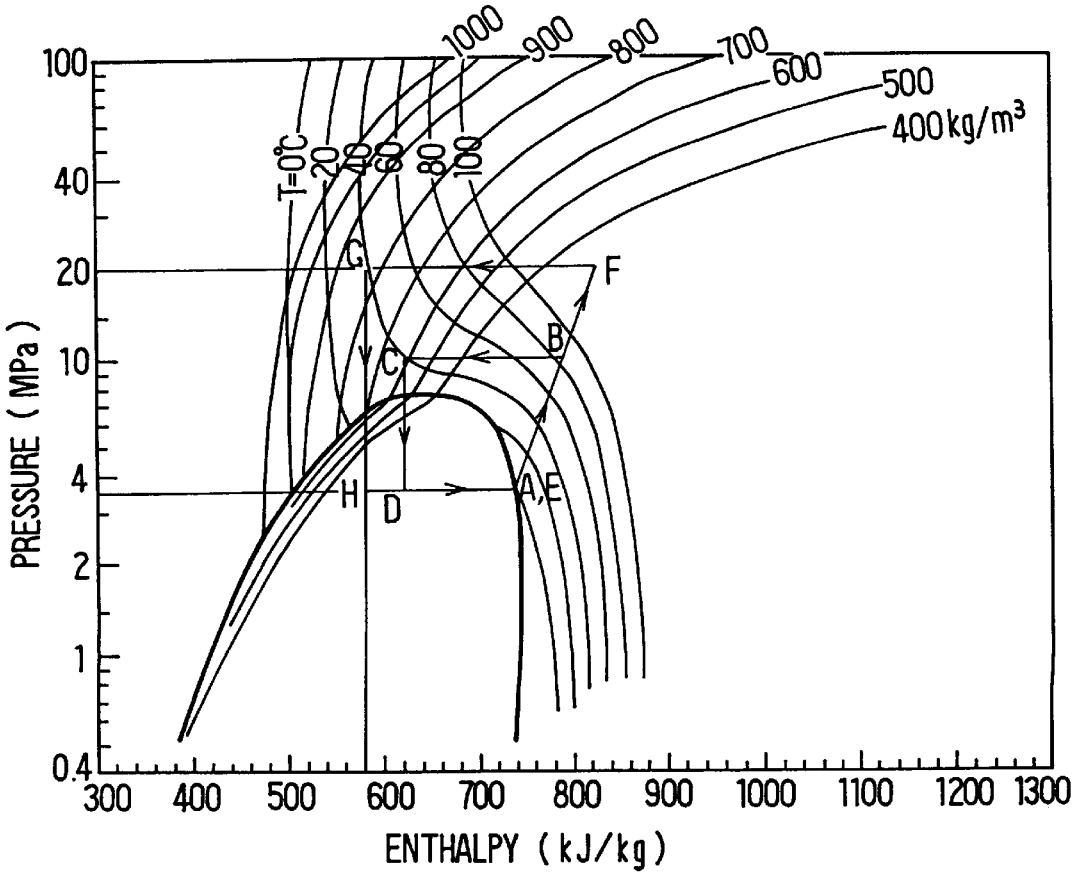
FIG. 7 PRIOR ART
FIG. 7 is a Mollier chart of a $CO_2$-refrigerating cycle.

The header tank 3 is constructed by a columnar tank portion 32 forming the columnar shaped inside space 31, and a cap 33 covering both ends of the tank portion 32 in the longitudinal direction thereof. The tubes 21 are inserted into the insertion holes 32*c* (FIG. 5) penetrating the tank portion 32 in the thickness direction thereof.

The inside wall surface 33*a* of the cap 33, facing the inside space 31, is formed into a spherical surface, and the outside wall surface 33*b* thereof is formed into a flat shape perpendicular to the longitudinal direction of the tank portion 32 (header tank 3).

Here, the tank portion 32 is made of aluminum (A3003) and formed by a drawing process, and the brazing material is clad on the inside wall surface 32*a* of the tank portion 32. The cap 33 is made of aluminum and formed by a machining process or a die-cast method.

The tube 21 is inserted into the tank portion 32 while penetrating the insertion hole 32*c*, and brazed integrally to the tank portion 32 as well as the cap 33 by the brazing material clad on the inside wall surface 32*a* of the tank portion 32.

A connecting portion "A" between the inside wall surface 33*a* of the cap 33 and the inside wall surface 32*a* of the tank portion 32 is separated away from a connecting portion "B" between the outside wall surface 21*b* of the tube 21 (FIG. 2) and the inside wall surface 32*a* of the tank portion 32 by a predetermined distance L, as shown in FIG. 3. It is preferable that the predetermined distance L is 0.5 times more than the thickness t of the tank portion 32. In the present embodiment, the distance L is about 3 mm.

Figure 4:
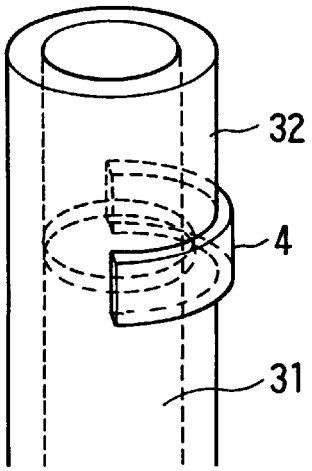
FIG. 4 is an enlarged perspective view of circle D in FIG. 1.

The inside space 31 of the header tank 3 (tank portion 32) is partitioned into plural spaces by separators 4. The separators 4 are brazed to both inside and outside wall surfaces 32*a*, 32*b* of the tank portion 32, as shown in FIG. 4.

A refrigerant inlet pipe 5 is provided at the upper portion of the tank portion 32. The refrigerant inlet pipe 5 is connected to the discharge port of a compressor (not illustrated) in the $CO_2$-refrigerating cycle. A refrigerant outlet pipe 6 is provided at the lower portion of the tank portion 32. The refrigerant outlet pipe 6 is connected to the inlet port of a pressure reducing member of the $CO_2$-refrigerating cycle. Here, in FIG. 1, a solid-line arrow and a broken-line arrow denote flows of the refrigerant ($CO_2$).

According to the present embodiment, the inside space 31 is formed into a shape the inside surface of which is formed by a curved surface without a sharp corner. That is, the inside wall surface 33*a* of the cap 33 is connected tangentially and smoothly to the inside wall surface 32*a* of the tank portion 32. Thus, the stress concentration is reduced at the connecting portion, thereby increasing the pressure-strength of the tank portion 32.

In the heat emitter 1 according to the present embodiment, there are only two connecting portions influenced by an inside refrigerant pressure, which are a connecting portion between the tube 21 and the tank portion 32, and a connecting portion between the cap 33 and the tank portion 32. However, in the prior art disclosed in the above JP-U-63-54979, the heat emitter is constructed by stacking and brazing a plurality of thin plates formed into a predetermined shape. That is, there are more connecting portions than that in the present embodiment. Therefore, when the prior art heat emitter is carried on a vehicle which tends to vibrate, because a vibrating force is added to a refrigerant ($CO_2$) pressure, the pressure-strength of the heat emitter decreases.

Contrary to this, in the heat emitter 1 according to the present embodiment, the pressure-strength of each the tube 21, the tank portion 32, and the cap 33 is increased, and the connecting portions influenced by the inside pressure are only two portions as above described. Thus, a high pressure-strength is attained entirely in comparison with that in the prior art heat emitter.

Here, when the connecting portion A and the connecting portion B are placed at the same position, i.e., the distance L is 0 (zero), most of the brazing material clad on the inside wall surface 32*a* of the tank portion 32 is suctioned into a cap-gap (a minute gap between the cap 33 and the inside wall surface 32*a* of the tank portion 32) by a capillary action thereof during the brazing operation. Thus, the brazing material is hardly suctioned into a tube-gap (a minute gap between the outside wall surface 21*a* of the tube 21 and the insertion hole 32*c* of the tank portion 32) and stored in the tube-gap.

As a result, the brazing material flows into the tube-gap insufficiently, and a brazing deterioration may occur between tube 21 and the header tank 3.

However, in the present embodiment, because the connecting portion A is distant from the connecting portion B by the predetermined distance L, the brazing material clad between these connecting portions A, B is suctioned into the tube-gap also by a capillary action of the tube-gap. Thus, the brazing material flows into the tube-gap sufficiently, thereby brazing the tube 21 to the header tank 3 firmly.

Further, the outside wall surface 33*b* of the cap 33 is formed into the flat shape perpendicular to the longitudinal direction of the tank portion 32, that is, the outer shape of the header tank 3 is formed into a columnar-like shape both ends of which are flat covered. Therefore, the thickness of the end corner portions 3*a* (FIG. 1) of the header tank 3 are large, thereby increasing the strength of the header tank 3 to an outer force acting on the cap 33 from the outside.

Further, because the brazing material is clad on the inside wall surface 32*a* of the tank portion 32, the brazing material can be clad while the tank portion 32 is formed by the drawing process. Thus, the brazing material is clad easily in comparison with that the brazing material is clad on the tube 21 or the cap 33.

Here, the present invention is not limited to the heat exchanger in which the brazing material is clad on the inside wall surface 32*a* of the tank portion 32, and may be applied to a heat exchanger in which the brazing material is clad on the outside wall surface 21*a* of the tube 21.

Generally, when the brazing material is clad on the outside wall surface 21*a* of the tube 21, the brazing material is not clad on the tank portion 32 which contacts the tube 21 for preventing the core material clad with the brazing material from being eroded by the brazing material during the brazing operation.

Thus, when the connecting portions A and B are placed at the same position, i.e., the distance L is 0 (zero), the brazing material clad on the outside wall surface 21*a* of the tube 21 is suctioned not only into the tube-gap, but also into the cap-gap. As a result, an amount of the brazing material in the tube-gap is reduced, thereby deteriorating the brazing performance in the tube-gap.

However, in the present invention, the connecting portion A is distant from the connection portion B, the brazing material is suppressed from being suctioned into the cap-gap, thereby preventing the deterioration of the brazing performance in the tube-gap.

Here, the brazing operation of the cap-gap is done by cladding the brazing material on the outside wall surface 33*b* of the cap 33, or by putting an O-ring like brazing material on the top portion of the tank portion 32.

The outer shape of the header tank 3 may be like a prism both ends of which are flat.

In the above-described embodiment, the inside wall surface 33*a* of the cap 33 is formed by only the spherical surface. Alternatively, as shown in FIG, 6, the inside wall surface 33*a* may be formed by a spherical surface and a plane surface, in which the inside wall surface 33*a* of the cap 33 is connected smoothly to the inside wall surface 32*a* of the tank portion 32*a* through a circular arc.

What is claimed is:

1. A heat exchanger comprising:

a plurality of tubes through which fluid flows;

a tank portion provided at an end of said tubes, and extending in a direction perpendicular to a longitudinal direction of said tubes, said tank portion forming a columnar inside space communicating with said tubes, and including a plurality of insertion holes into which said tubes are inserted; and a cap covering an end portion of said tank portion, and having a concave inside wall surface that, together with an inside wall surface of said tank portion defines a convex tank end portion including a smooth transition surface at a first connecting portion between said concave inside wall surface and said inside wall surface of said tank portion, wherein said inside wall surface of said tank portion and an outside wall surface of said tube are connected to each other at a second connecting portion, and said first connecting portion is separated away from said second connecting portion by a predetermined distance.

2. A heat exchanger according to claim 1, wherein said inside wall surface of said cap is in an only spherical shape.

3. A heat exchanger according to claim 1, wherein said inside wall surface of said cap is in a spherical shape and a flat shape.

4. A heat exchanger according to claim 1, wherein said predetermined distance is 0.5 times more than a thickness of said tank portion.

5. A heat exchanger according to claim 1, further comprising a brazing material clad on an inside wall surface of said tank portion to braze said tank portion and said cap together.

6. A heat exchanger according to claim 1, wherein said cap and said tank portion construct a header tank, and an outer shape of said header tank is formed into a columnar-like shape both ends of which are flat covered.

7. A heat exchanger comprising:

a plurality of tubes through which fluid flows;

a tank portion provided at an end of said tubes, and extending in a direction perpendicular to a longitudinal direction of said tubes, said tank portion having an inside wall surface forming a columnar inside space communicating with said tubes, and including a plurality of insertion holes into which said tubes are inserted; and a cap covering an end portion of said tank portion, and having a concave inside wall surface which faces said inside space, said inside wall surface of said tank portion tangentially engaging said concave inside wall surface of said cap to form a first connection portion, wherein said inside wall surface of said tank portion and an outside wall surface of said tube are connected to each other at a second connecting portion, and said first connection portion is separated away from said second connecting portion by a predetermined distance.

8. A heat exchanger comprising:

a plurality of tubes through which fluid flows;

a tank portion provided at an end of said tubes, and extending in a direction perpendicular to a longitudinal direction of said tubes, said tank portion having an inside wall surface forming a columnar inside space communicating with said tubes, and including a plurality of insertion holes into which said tubes are inserted; and a cap covering an end portion of said tank portion, and having a concave inside wall surface which faces said inside space, said inside wall surface of said tank portion being generally parallel to said concave inside wall surface of said cap at a first connecting portion, wherein said inside wall surface of said tank portion and an outside wall surface of said tube are connected to each other at a second connecting portion, and said first connection portion is separated away from said second connecting portion by a predetermined distance.

* * * * *